United States Patent [19]

Splendora

[11] 4,304,076

[45] Dec. 8, 1981

[54] MONUMENTS

[76] Inventor: Joseph Splendora, Shanna House, Milford, Pa. 18337

[21] Appl. No.: 32,987

[22] Filed: Apr. 25, 1979

[51] Int. Cl.[3] ..... E01F 9/02

[52] U.S. Cl. ..... 52/104; 40/124.5; 428/13

[58] Field of Search ..... 52/103, 104; 40/124.5; 428/13

[56] References Cited

U.S. PATENT DOCUMENTS

| | | | |
|---|---|---|---|
| D. 191,248 | 8/1961 | Gialoseta | 40/124.5 X |
| 214,339 | 4/1879 | Wimer . | |
| 748,284 | 12/1903 | Karwowski | 52/104 X |
| 1,274,809 | 8/1918 | Storm, Jr. | 40/124.5 X |
| 2,124,143 | 7/1938 | Long | 40/124.5 |
| 2,881,562 | 4/1959 | Ragot | D11/117 X |
| 2,946,945 | 7/1960 | Regnier et al. | 60/641 X |
| 3,028,488 | 4/1962 | Hudspeth et al. | 60/641 X |
| 3,613,265 | 10/1971 | Stern et al. | 428/13 X |
| 4,021,908 | 5/1977 | Shulman | 428/13 X |
| 4,054,000 | 10/1977 | Lisle | 52/104 X |

*Primary Examiner*—Carl D. Friedman

*Attorney, Agent, or Firm*—Steele, Gould & Fried

[57] ABSTRACT

A headstone, grave marker or the like, comprising a substantially transparent member, having means for maintaining the member in upstanding position, and means depicting information pertinent to a decedent displayed on said member. The information may be inscribed on the surface of the member, or the information may be embedded within the member, being nevertheless visible. The information depicting means may comprise members having written information, or merely three dimensional objects indicative of the significant aspects of the decedent's life. The monument is preferably molded from plastic material, and the sides of the member may be disposed at such angles with respect to one another that the information is reflected in at least one of the sides.

9 Claims, 5 Drawing Figures

MONUMENTS

BACKGROUND OF THE INVENTION

1. Field of the Invention

This invention relates to monuments in general, and in particular, to novel monuments used as headstones, grave markers and the like.

2. Prior Art

It has been known to embed small items, such as coins, dried flowers and the components of a watch in small blocks or plaques made of transparent or translucent material, such as plastic. However, these materials have never before been considered suitable for use on a much larger scale as grave markers or headstones, wherein the transparent or translucent plastic member is in combination with means depicting information pertinent to a decedent.

Heretofore, grave markers, headstones and the like are carved from granite or marble, and may or may not have metal plaques affixed thereto. All but the simplest of these prior art monuments are expensive, unwieldy and often simply not attractive for many people.

This invention seeks to provide personalized grave markers, headstones and the like which are novel in appearance, are relatively inexpensive to produce, and further, which may be produced in almost any desired shape and may utilize virtually any kind of information depicting means. For example, if one wished to construct a fitting memorial for a concert violinist, the best one might do using prior art materials and construction methods would be to have the outline of a violin engraved on a stone marker or to have an expensive statuette in the form of a violin for affixation to a conventional grave marker or headstone. By use of this invention, one might have an inexpensive model of a violin constructed, which could then be embedded within a transparent or translucent grave marker or headstone, providing a testament more eloquent than any number of words. As a further advantage, the prior art statuette would be subject to weathering and vandalism, whereas the violin model embedded in a grave marker according to this invention would be safely maintained throughout the ages. To carry the effect even further, one might even construct the entire headstone in the form of a violin. This might involve some expense in addition to that of a more conventionally shaped headstone, but would certainly be much much less expensive then carving a violin in granite or marble. That which was unattainable for all but the wealthiest persons in the matter of highly personalized grave markers and headstones would now be available for nearly everyone.

SUMMARY OF THE INVENTION

It is an object of this invention to provide a monument for use as a grave marker, headstone or the like, comprising a substantially transparent member, having means for maintaining the member in an upstanding position, and means depicting information pertinent to the life of a decedent displayed on the member.

It is a further object of this invention to provide a monument as described wherein the information is inscribed on the member.

It is a further object of this invention to provide a monument as described, wherein the information depicting means is embedded within the member, being nevertheless visible.

It is still another object of this invention to provide a monument as described, wherein the information depicting means embedded within the member comprises a three dimensional object or the like.

It is yet another object of this invention to provide a monument as described, wherein the sides of the member are disposed at such angles with respect to one another that the information is reflected in at least one of the sides.

It is yet another object of this invention to provide a monument as described, in further combination with means for lighting the member.

It is yet another object of this invention to provide a monument as described, wherein the member is molded from plastics material.

It is yet another object of this invention to provide a monument as described, wherein the member itself is in the form of a three dimensional object or the like, pertinent to the life of a decedent.

These and other objects of this invention are accomplished by a monument for use as a grave marker, headstone or the like, comprising a substantially transparent member, having means for maintaining the member at an upstanding position, and means depicting information pertinent to a decedent displayed on the member. The information may be inscribed on a side of the member, or may be embedded within the member. The information embedded within the member may comprise a three dimensional object or the like, or in the alternative, the member may itself be in the form of a three dimensional object or the like. The monument may be molded from plastics material, and suitable dyes may be used to provide translucent markers in different colors. The invention further contemplates the monument as described in combination with means for lighting the member.

BRIEF DESCRIPTION OF THE DRAWINGS

For the purpose of illustrating the invention, there are shown in the drawings forms which are presently preferred; it being understood, however, that this invention is not limited to the preceise arrangements and instrumentalities shown.

DETAILED DESCRIPTION OF PREFERRED EMBODIMENT

Figure 1:
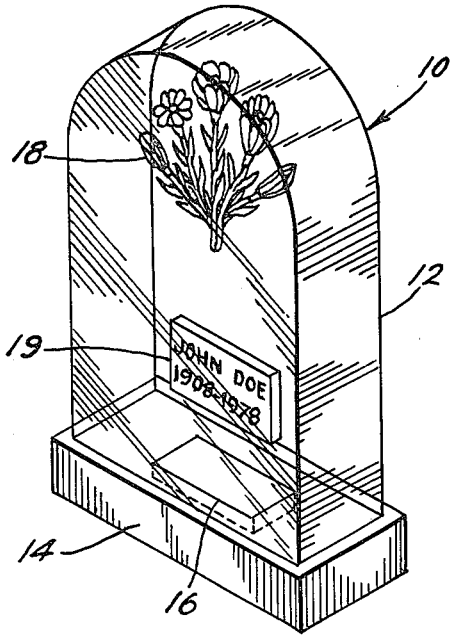
FIG. 1 is a perspective view of a transparent monument according to this invention.

A monument according to this invention in the form of a transparent grave marker or headstone 10 is illustrated in FIG. 1. Monument 10 comprises a transparent or substantially transparent member 12, which may be molded from a plastic material. The member 12 is supported in an upstanding position by base member 14, which may be of any suitable material. If desired, the base may also be provided with a means 16 for illuminating the member 12 from within. Even a small source of illumination will be able to suffuse a softly glowing light throughout the member 12. Means depicting information pertinent to the life of a decedent may be displayed in or on the member 12. In FIG. 1, the information depicting means comprises a bouquet of flowers 18 and a metal plaque 19. The information depicting means may be decorative in the conventional sense, utilizing flowers, scroll work, inscriptions or the like, or may be one or more objects thought to be symbolic of the most significant aspects of the decedent's life. Merely by way of illustration, without intending to be limited, such objects might include a model or replica of a musical instrument, a model of a vehicle, such as automobiles, airplanes or spaceships, a book or books, including holy books or perhaps even a diarama depicting a seminal event. The important factor to consider is not what object or objects or representations may be utilized, but the fact that whatever the object or objects, they may be incorporated into a grave marker or headstone at comparatively nominal costs, when compared to the traditional methods of carving personalized granite or marble or casting conventional statuary. For the first time, this invention places highly personalized grave markers or headstones within the financial reach of almost anyone, rather than just the wealthy.

Figure 2:
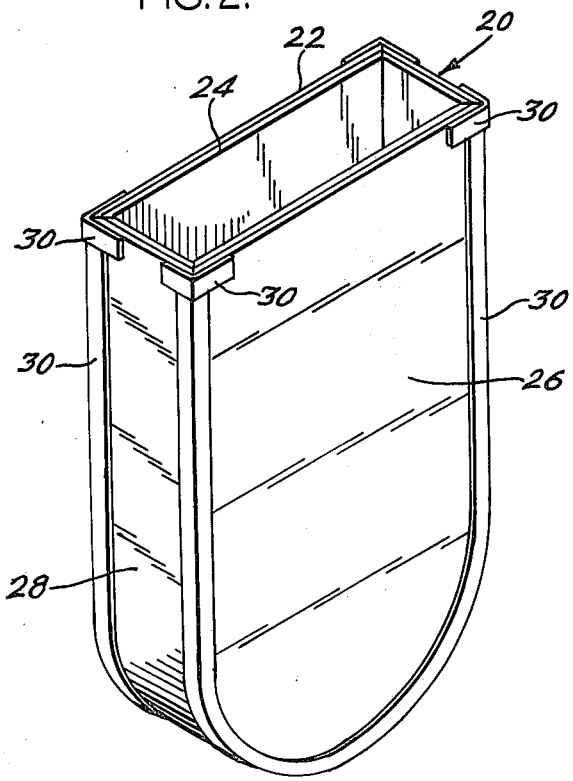
FIGS. 2, 3 and 4 sequentially illustrate a method for constructing a monument according to this invention; and, FIG. 5 is a perspective view of a further embodiment of a monument according to this invention, incorporating solar powered lighting means.
Figure 4:
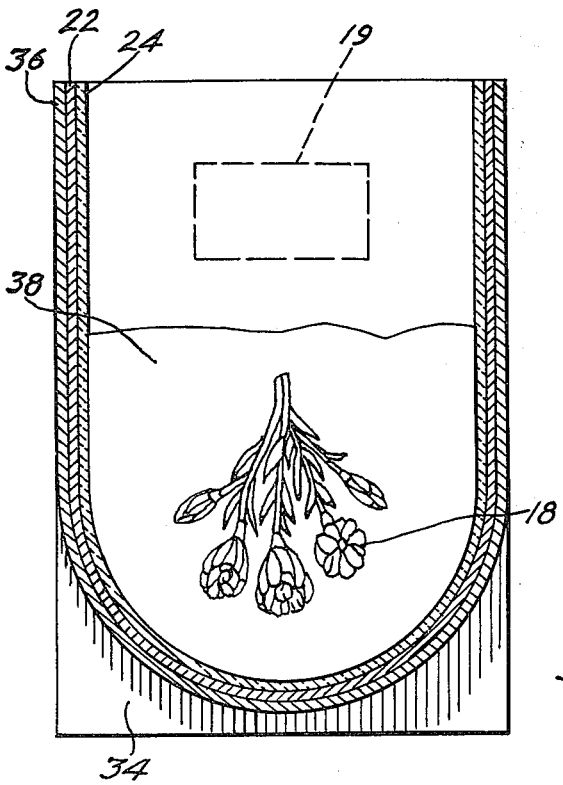
Figure 3:
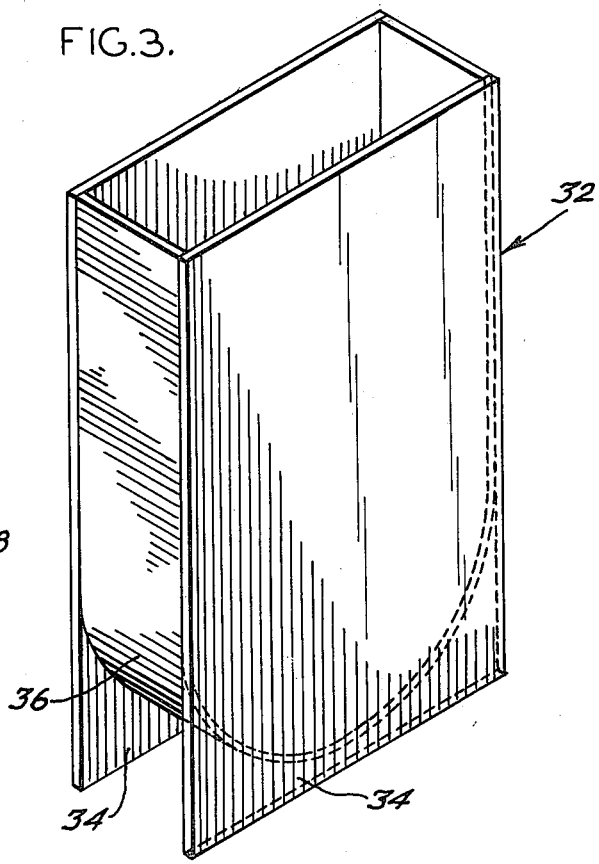

A method for constructing monuments in accordance with this invention, and in particular, the monument illustrated in FIG. 1, is sequentially illustrated in FIGS. 2, 3 and 4. The first step is to fashion a mold 20, in the desired shape of the finished product. The mold should be slightly larger in all dimensions, to allow for shrinkage of the molding material. The mold 20 may be made from metal, glass, paper or any other material that will hold its shape and will not allow air to pass therethrough. One suitable material is 0.040 inch thick card stock 22, having a sheet of glassine 24, applied with a wax to the inside of the card stock. The card stock may be purchased with the glassine already affixed. In this instance, the mold comprises two side members 26 and an edge member 28. The corners of the mold may be taped together with celophane tape 30, so that all seams are sealed.

The mold must then be fitted or placed within a plywood supporting frame or box 32, which as shown in FIG. 3, is the same shape as the mold 20. The support 32 comprises two side panels 34 and edge panel 36, which may both be constructed from plywood or the like. As a matter of convenience, the side panels 34 are shown as rectangular, in order to provide a stable base for supporting the mold.

After the mold has been inserted into supporting member 32, the molding material 38 is mixed and poured into the mold. A suitable molding material comprises approximately equal portions of methyl methacrylate monomer and methyl methacrylate polymer. The mixture of these two components forms a slurry which may be easily poured into the mold. If a translucent or colored monument is desired, then a suitable dye or dyes may be added at this time. This process is normally repeated as many times as is necessary to fill the mold. If it is desired to place information depicting means in the form of an object or objects within the member 12, the casting process is interrupted at the level at which the embedment is to take place, and the slurry is allowed to thicken to a firm dough-like consistency. When the dough-like consistency has been attained, the embedment is laid in and the casting continues.

When the casting process is complete, the entire mold and supporting structure is placed into an autoclave, subjected to approximately 100 PSI atmosphere of nitrogen, to reduce the possibility of explosion, and sufficient heat to initiate the polymerization reaction of the ingredients. Once polymerization starts, it will sustain itself due to the exothermic nature of the reaction. After a sufficient time, the entire mass will be completely polymerized and may then be removed from the autoclave.

After the mold is removed from the autoclave, the casted member 12 may be removed from the mold and then machined, buffed and polished as desired.

The member 12 may be affixed to the base means 14 by adhesives or other attachment means, such as bolts or the like. Such bolts may be screwed directly into threaded holes drilled and tapped into the bottom face of the member 12 after molding, or if desired, threaded plugs may be inserted into the mold prior to heating and polymerization.

It will be appreciated that a monument according to this invention may be formed in virtually any shape for which a mold can be constructed, can be made in virtually any color, from transparent or substantially transparent, through translucent and opaque, and may have embedded therein virtually any object or objects. Notwithstanding the extent to which a customized or highly personalized monument may be constructed, the relative cost is nominal as compared to that of highly personalized conventional monuments, carved from granite or marble, or comprising expensive sculptures and statuary. For the first time, highly personalized memorial monuments will now be available to all families, even those of the most modest means.

Figure 5:
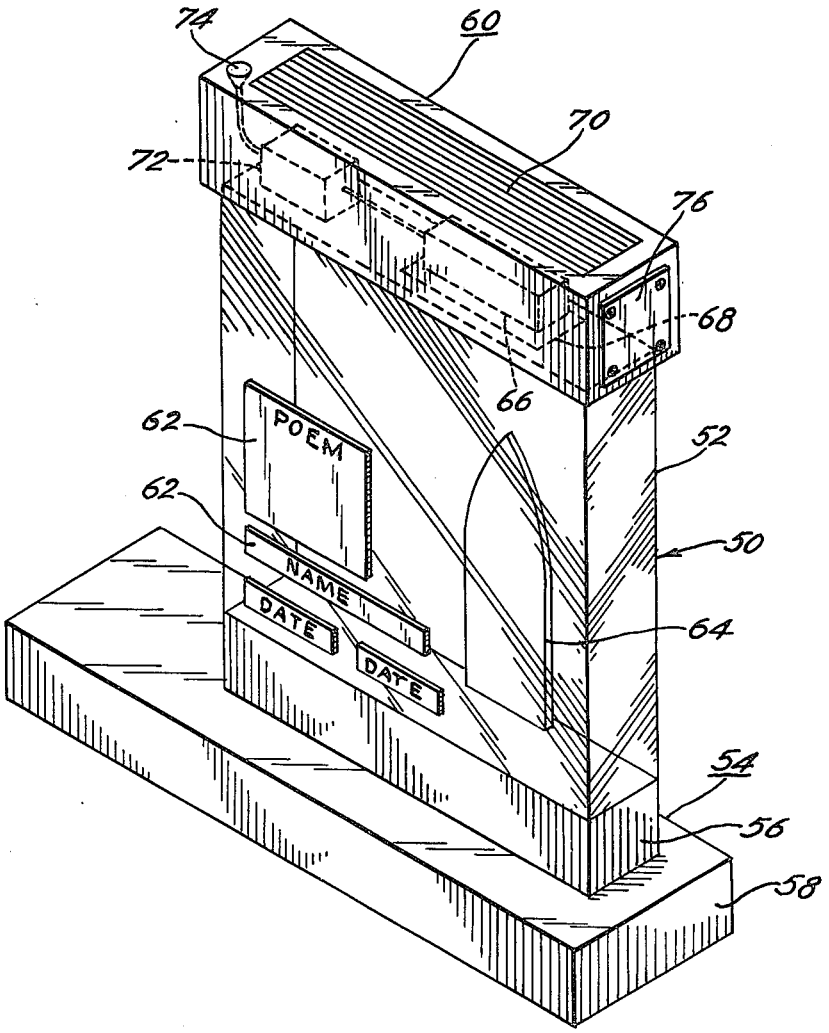

A further embodiment of this invention, utilizing solar power, is illustrated in FIG. 5. The monument 50 comprises a substantially transparent member 52, base means 54, having upper and lower members 56 and 58, and cap or cover means 60. Member 54 has information bearing plates 62 affixed thereto and embedment 64 disposed or molded therein.

The cap or cover means 60 is provided with means 66 for lighting the member, the light shining through rough and unpolished section 68 in the top of member 52. The lighting means 66 may be powered by solar cells 70, disposed in the top of cap 60. Control means 72 is also disposed in the cap for controlling the solar cells and lighting means. Control means 72 may have a light sensor 74 and/or a 24-hour clock. Access to the components may be through side panels 76. Such an arrangement, as shown, is fully self-contained.

The present invention may be embodied in other specific forms without departing from the spirit or essential attributes thereof, and accordingly, reference should be made to the appended claims, rather than to the foregoing specification as indicating the scope of the invention.

I claim:

1. A monument for use as a headstone or the like, comprising a single, unitary, substantially transparent molded member;

means for maintaining the member in an upstanding postion;

means depicting information pertinent to the life of a decedent displayed on said member;

lighting means for artificially illuminating said member; and, self-contained, solar energized means for powering the lighting means.

2. The monument of claim 1, wherein said member is translucent.

3. The monument of claims 1 or 2, wherein said information depicting means is embedded in said member, being nevertheless visible.

4. The monument of claim 1, wherein said information is inscribed on said member.

5. The monument of claims 1 or 2, wherein said member further comprises a roughened area on an edge of said transparent member, through which said light suffuses through said member, said lighting means covering said edge and preventing other light from entering said member through said roughened area.

6. The monument of claims 1, 2 or 4 wherein said member is molded from plastic material.

7. The monument of claims 1, 2 or 4 wherein said member has sides which are disposed at such angles with respect to one another that said information is reflected in at least one of said sides.

8. The monument of claims 1 or 2, wherein said information depicting means comprises a three dimensional object embedded in said member.

9. The monument of claims 1 or 2, wherein said member is formed as a three dimensional object pertinent to the life of the decedent.

* * * * *

UNITED STATES PATENT AND TRADEMARK OFFICE

CERTIFICATE OF CORRECTION

PATENT NO. : 4,304,076

DATED : December 8, 1981

INVENTOR(S) : JOSEPH SPLENDORA

It is certified that error appears in the above-identified patent and that said Letters Patent are hereby corrected as shown below:

At col. 4, line 54 (claim 1, line 2), after "comprising" insert --:--, and indent the remainder of that line, namely "a single, unitary, substantially transparent molded member;".

At col. 4, line 57 (claim 1, line 5), delete "postion" and insert --position--.

Signed and Sealed this

*Sixteenth* Day of *February 1982*

[SEAL]

*Attest:*

GERALD J. MOSSINGHOFF

*Attesting Officer*

*Commissioner of Patents and Trademarks*